US005560734A

United States Patent [19]

McIntosh et al.

[11] Patent Number: 5,560,734

[45] Date of Patent: Oct. 1, 1996

[54] BITUMASTIC SIMULATED PAVED SURFACE

[75] Inventors: James McIntosh; Graham J. Lucas, both of Uckfield, United Kingdom

[73] Assignee: Roadtex Limited, East Sussex, United Kingdom

[21] Appl. No.: 397,088

[22] PCT Filed: Aug. 27, 1993

[86] PCT No.: PCT/GB93/01832

§ 371 Date: Mar. 7, 1995

§ 102(e) Date: Mar. 7, 1995

[87] PCT Pub. No.: WO94/05861

PCT Pub. Date: Mar. 17, 1994

[30] Foreign Application Priority Data

Sep. 9, 1992 [GB] United Kingdom ..... 9219105
Sep. 9, 1992 [GB] United Kingdom ..... 9219106

[51] Int. Cl.[6] ..... E01C 7/35; E01C 19/43; E01F 9/04

[52] U.S. Cl. ..... 404/15; 404/32; 404/77; 404/79; 404/93

[58] Field of Search ..... 404/15, 31, 32, 404/77, 79, 82, 93, 94

[56] References Cited

U.S. PATENT DOCUMENTS 4,130,516 12/1978 Gagle et al. ..... 404/32 X
5,026,609 6/1991 Jacob et al. ..... 404/31 X
5,033,906 7/1991 Jordan ..... 404/124
5,122,009 6/1992 Vivier ..... 404/31
5,215,402 6/1993 Stowell et al. ..... 404/93

FOREIGN PATENT DOCUMENTS 483995 5/1992 European Pat. Off. .

*Primary Examiner*—George A. Suchfield
*Attorney, Agent, or Firm*—Keck, Mahin & Cate

[57] ABSTRACT

A method of laying a bitumastic simulated paved surface includes spreading a layer of hot bitumastic material on a foundation layer, the bitumastic material including a thermoplastic rubber copolymer material, filler and reinforcing fibres, allowing the bitumastic material to cool and set, heating the surface of the bitumastic material to soften it for moulding purposes, and imprinting the softened surface with a pattern of grooves to provide simulated gaps between simulated slabs of paving. A layer of bitumastic material has a simulated paved surface, including bitumen, hydrocarbon resin, block copolymer rubber, fillers and reinforcing fibre material, and a groove pattern is impressed into the upper surface of the layer in a pattern to simulate the joints in a paved surface. A road speed control hump of material, includes a hump of material applied to the road, the material including a mixture having rubber chips bound together with a bituminous binder, and a layer applied to the surface of the hump.

52 Claims, No Drawings

BITUMASTIC SIMULATED PAVED SURFACE

FIELD OF THE INVENTION

This invention relates to a method of laying a bitumastic simulated paved surface, to a paved surface so-laid and to bitumastic material particularly suitable for use in such a surface layer.

BACKGROUND OF THE INVENTION

There has been increased use recently of attractively paved surfaces which may use differently coloured stone slabs or bricks for use as a walk-on or drive-on paved surface with an aesthetically pleasing appearance, in some cases areas of different coloured bricks or paving providing guidance for drivers of vehicles, for example in showing routes and individual parking areas in car parks. A difficulty with such paved surfaces is their expense, particularly where individual slabs, bricks or blocks are laid since first a good foundation needs to be provided and then the paving needs to be carefully laid on that foundation, with it being necessary for the foundation and the blocks to be very stable and very firmly laid, in order to avoid the possibility of cracking the blocks under vehicle loading. It has been proposed to use a concrete simulated paved area in which concrete is laid and, while it is still soft, grooves are provided in its upper surface to simulate the spaces between individual paving stones. This concrete can be coloured to give the appearance of, for example, a brick laid area but generally this prior process has the disadvantage of the expense due to the need to excavate and provide a substantial foundation, with the concrete layer itself needing to be at least 150 mm thick if it is to be able to resist cracking and bear the load of vehicles passing thereover.

SUMMARY OF THE INVENTION

The present invention has an object to provide an improved surfacing material which will give the appearance of a paved area and which not only will be less expensive to lay but will also provide advantages as regards resistance to wear and waterproofing, as compared with prior surfacing.

An exemplary use of the simulated paved layer is to improve the appearance of traffic speed control humps on roads. In this connection, it should be noted that while herein we have referred to speed control humps, this term is also intended to cover speed control ramps and tables which are alternative terms sometimes used depending upon the cross-section of the hump and whether it has a substantially flat top surface.

There has, in recent years, been a development of the use of speed control humps for use in traffic calming schemes where humps are applied across the road to encourage drivers to drive more slowly if their travel is not to be made too uncomfortable or their vehicle damaged, due to excessive speed over the humps. Conventionally, these humps are presently produced either by using a tarmac material applied over the road where the hump is to be formed or by fabricating them using concrete paving blocks. The use of "MACADAM" road surfacing material, whilst cheap, is undesirable, especially where quite heavy traffic loads may be expected since "MADADAM" road surfacing material control humps tend to break up with the shock of repeated impacts from traffic wheels. Accordingly, the presently preferred construction is that using paving blocks but humps made using such blocks are several times more expensive than the "TARMACADAM" road surfacing material ones, due to the amount of preparation of the road, excavation being required to provide a proper foundation for the blocks, the increased expense of laying the blocks and the increased cost of the blocks themselves as compared with "TARMACADAM" road surfacing material.

DESCRIPTION OF THE PREFERRED EMBODIMENTS

The present hump has some degree of resilience which whilst not in any way detracting from the effect of the hump in discouraging fast vehicle travel thereover, is far more resistant to wear, especially under high traffic loads, than the previous "TARMACADAM" humps and which is substantially cheaper to lay than the humps produced using blocks. Additionally, the softer more resilient structure for the humps means that if on a relatively high hump there is a tendency for the bottom or exhaust system of a car to graze the hump, it is likely to be less damaging than contact with the very firm and hard previous "TARMACADAM" road surfacing material or block humps. Whilst humps of varying heights and shapes are used, the preferred recommended height for humps is between 50 and 100 mm with the 100 mm height being the more effective but being less desirable in some situations, for example on routes having a high frequency bus service thereover. The presently recommended maximum height for humps is 100 mm and this can apply whether the hump is a relatively short hump with a curved top or whether it is a long hump with a flat centre portion having ramps leading up thereto from either direction.

According to the present invention, there is provided a method of laying a bitumastic simulated paved surface which comprises spreading a layer of hot bitumastic material on a foundation layer, the bitumastic material including a thermoplastic rubber copolymer material, filler and reinforcing fibres, allowing the bitumastic material to cool and set, optionally heating the surface of the bitumastic material as required to soften it for moulding purposes, and imprinting the softened surface with a pattern of grooves to provide the required simulated gaps between the slabs of the required simulated paving.

While it is preferred that the bitumastic material is allowed to cool and set substantially so that further heating is required before it is soft enough for moulding, it is contemplated that careful control of the timing of the moulding process would enable it to be carried out when the bitumastic material has cooled to just the right temperature for moulding to be effective. However, this would require very careful control and it is preferred to allow the bitumastic material to cool and set and then simply to heat the surface of the material to soften it to an adequate extent to permit moulding. In doing it this way, the main depth of the material layer remains firm and it is only the upper layer which is softened to the depth necessary to allow the moulding tool to imprint the required grooves. It is found that when sand is brushed into the grooves, it remains in situ even in rain and despite continual passage of vehicles thereover, assisting in providing the appearance of pointing between the individual paving blocks.

Conveniently, the bitumastic material can contain a colouring, for example red oxide when the finished surface is to simulate brick paving.

A surface dressing may be applied to the layer, either while the layer is still hot when first laid or during a later operation when it can be adhered to the upper surface, after first applying a layer of epoxy resin to the upper surface of the moulded layer.

According to an exemplary aspect of the present invention, there is provided a method of providing a speed control hump on a road in which material is provided to the surface of the road to form the hump, this material comprising rubber chips bound together with a bituminous binder, and a layer of simulated paving is applied to the hump using the method of the invention.

Preferably, the hump material includes chopped fibres, for example fibreglass or metal fibres which help to bind the material together to form a strong bound mass which is still capable of flexing. Preferably, the amount of chopped fibres is less than 1% by weight of the mixture and a satisfactory content has been obtained when the rubber chips themselves have been obtained by shredding rubber tires, preferably after removal of the tire beads, by passing the tires through a mill when the milling action, as well as breaking down or shredding the rubber to form the chips, also breaks up the fibres used in the tire for reinforcement purposes with the wire reinforcement becoming detached and unravelled forming fibres having a mean length of about 2 cm. This milling operation can also provide the preferred size of the rubber chips, which may have a particle size of up to 20 mm, preferably 5 to 15 mm. While the chips may be generally single sized, it is possible to use rubber chips of two or more different sizes. Where a single size is used, 8 or 9 mm dimensioned chips are suitable for general purposes although in different locations, depending upon traffic loading and road conditions, other sizes may be used.

In general, where chopped fibres are added specifically to the mixture, they may conveniently comprise glass and/or metal fibres.

Preferably, the bituminous binder comprises a mixture of bitumen and hydrocarbon resin. A suitable hydrocarbon resin is a resin produced by the controlled polymerisation of unsaturated $C_5$ petroleum fraction and has a softening point of approximately 95° to 105° C. An example of such a hydrocarbon resin is that which is sold under the tradename of "IMPREZ 100" hydrocarbon resin by ICI. The hydrocarbon resin is dissolved in the bitumen.

Preferably, the binder includes a proportion of fillers and also the material may have a proportion of aggregate included. Generally, the rubber chips will comprise 5 to 30% by weight of the material. Thus, a suitable exemplary composition for the material comprises 5 to 10% bitumen, 5 to 10% hydrocarbon resin, up to 40% mineral fillers, up to 30% rubber chips and the balance as aggregate. The mixture itself may be flexibilised with a thermoplastic rubber copolymer material, suitable copolymer materials being styrene butadiene styrene or styrene isoprene styrene. Such copolymer material may comprise substantially 1 to 2% by weight of the material used to form the speed control hump. A particular example composition for this preferred hump material comprises, by weight, approximately 5 parts bitumen, 5 parts hydrocarbon resin, 1 part thermoplastic block copolymer rubber, 30 parts mineral fillers, 35 to 45 parts aggregate, 5 to 30 parts rubber chips and less than 1 part fibre.

Where aggregate is used, it preferably has a particle size similar to that of the rubber chips, that is a particle size of up to 20 mm, preferably 5 to 15 min. Generally, when applying the material to form the speed control hump, it will be applied hot to the road using a screeding process and then allowed to solidify, once it has been given the required shape. However, in an alternative arrangement, the hump may be preformed and adhered to the road surface with adherent bitumen. Alternatively, the hump may be applied as preformed sections, adhered to the road, and then have a further flexible layer provided thereover in situ, as by a hot screed process.

In applying the hump material to the road, in order to form a hump, the road surface is initially prepared. While in some cases this can simply comprise cleaning the road with adequate adhesion being given to the existing road surface, it is preferred that the road surface is scarified or milled, for example to a depth of 10 mm, before application of the hump material. Suitably, the top layer may comprise rubberised bitumen and may be provided with a contrasting colour, so that it is readily visible to the road user. This contrasting colour may simply be applied by dye added to or dissolved in the bitumen but alternatively, or in addition, the top layer may be coloured by the provision of small aesthetically coloured rubber chips. In order to provide a smooth and wear-resistant junction between the road and the top layer, it is preferred that troughs be provided adjacent the front and rear edges of the initially formed hump, with the edges of the applied layer being folded into the recesses provided by the troughs.

In general, the hump using the preferred material can be easily applied as a screed by being heated and hot applied to the road with the resin, which has a higher melting point than the bitumen, being dissolved in the bitumen, in order to provide a flexible, but wear- and shock-resistant material in cooperation with the rubber chips and possibly filler and aggregate included therein. The finish obtainable using the top simulated paving is especially suitable for use where, for example, the traffic calming hump may be formed as a flat-topped hump with ramp surfaces leading thereto, a pedestrian crossing being provided over the flat top of the hump. However, as indicated above, the hump may be preformed in one or more settings before being applied to the road. In the latter case, it is preferred to apply the finishing top layer over the assembled hump section or sections.

A further aspect of the present invention provides a layer of bitumastic material having a simulated paved surface, comprising bitumen, hydrocarbon resin, block copolymer rubber, fillers and reinforcing fibre material, a groove pattern having been impressed into the upper surface of the layer in a pattern to simulate the joints in a paved surface.

A bitumastic material suitable for use in the manufacture of a simulated paved surface comprises constituents in the following relative proportions: 30 to 70 liters of bitumen, up to 3 kg wetting agent, 30 to 170 kg hydrocarbon resin, 3 to 70 kg block copolymer rubber, 800 to 2000 kg filler, 2.5 to 40 kg inorganic fibres and 1.7 to 33 kg rubber chips.

A preferred material can comprise 55 to 70% hard screed material, up to 5% iron oxide, 10 to 15% crushed flint grit, 15 to 25% sand, up to 5% rubber chips having a particle size of 1 to 15 mm, up to 0.5% glass fibres and up to 1% metal fibres, the hard screed material having the proportions of between 150 and 250 liters 100 pen bitumen, up to 4 kg wetting agent, 150 to 300 kg hydrocarbon resin,. 20 to 70 kg block copolymer rubber, 1800 to 2400 kg fillers, and up to 10 kg of fibreglass.

Suitably the filler of the hard screed material may comprise approximately 2 parts by weight fine powder filler, for example, "ARTEX" whiting fine powder filler, 7 parts by weight sand, 4 parts by weight fine crushed flint grit, and 8 parts by weight of granite within the range of 1 to 15 mm in dimension, preferably single dimensioned 3 mm granite.

In a particular example of such a material which has been found to be satisfactory there is provided approximately 3% by weight iron oxide, 12% crushed flint grit, 20% sand, 0.4% rubber chips, 0.4% metal fibres and 0.2% glass fibres, excluding those included in the screed material.

Another example which we now expect to be very practical comprises approximately 10% by weight bitumen, 0.25% rubber crumb or granules, 10% "ARTEX" fine powder filler, 35% sand, 3 to 5% red pigment (iron oxide), 0.25% metal and glass fibres, 40% 1 to 3 mm aggregate, 0.25% wetting agent and 0.75% polymers.

The material is found to be particularly effective in that although it can be laid to a substantial depth, a very satisfactory hard-wearing surface can be obtained when it is laid to a depth of approximately 30 mm. The degree of resilience in the material enables it to be laid on cracked or relatively poor foundation with the material retaining its continuity even after continual use, so that it can provide a waterproofing function. In this connection, as well as being useful on roads and drives it is, therefore, particularly suitable for use in multistorey car parks, pedestrianised areas and the like. When used as a walkway, the construction is particularly useful since the main area of the simulated slabs will stay puddle free and rainwater can run away through the drainage provided by the grooves to one side or other of the simulated paved area.

By way of example, we will refer to another material which has been found to be particularly suitable. This comprises 62% by weight of hard screed material, 3% by weight of iron oxide, where the iron oxide is used as a colorant to give a simulated brick appearance to the product, 12% by weight of fine crushed flint grit, sold under the name "FLINTAG" No. 4 crushed flint grit, 20% by weight of 110 sand, 0.4% by weight of rubber chips, although suitable rubber chips may have a particle size of between 1 and 15 mm, a particularly suitable dimension is when it has a particle size between 1 and 3 mm, 0.2% glass fibres and 0.4% metal fibres.

The hard screed material can suitably comprise constituents in the proportions given by 170 liters 100 pen bitumen, 2 kg wetting agent, sold under the trademark "POLYRAM" wetting agent, 200 kg hydrocarbon resin, for example a resin produced by the controlled polymerisation of unsaturated $C_5$ petroleum fraction, having a softening point of approximately 95° to 105° C. and sold under the tradename ESCOREZ 1102" resin by Exxon, 40 kg of block copolymer rubber, to act as polymerising agent, for example that sold by Shell under the tradename CARRYFLEX 1107" polymerizing agent, 200 kg "ARTEX" whiting fine powder filler, which is a fine powder filler, 300 kg of 100 sand, 400 kg of 50 sand, 400 kg of crushed flint grit, as sold under the tradename "FLINTAG No. 4" crushed flint grit, 800 kg 3 mm granite, and 5 kg glass fibres.

As indicated above, it is preferred that this be laid on a foundation to a depth of suitably 20 to 100 mm, preferably 30 mm, which provides a suitable strength and wear resistance and also can be a depth allowed for the grooves to be impressed therein. When laid, it is allowed to cool and set since this then means that it is fully stabilised and it is only the upper surface which needs to be softened for the impression of the grooves. Conveniently, this can be done by applying a hot plate to the surface of the material and then, once the material has heated sufficiently, by removing the hot plate and using a moulding tool to impress the required shaped grooves into the surface to be imprinted.

A particularly good finish is provided when "FLINTAGE" No 4 crushed flint grit is adhered to the surface of the applied grooved layer. This can either be applied by being rolled onto the surface while it is still soft but before it has been grooved or by being applied to the surface and adhered thereto by a layer of epoxy resin. Clearly, where grit is applied, this can give a surface appearance different from the base colour of the layer itself which will depend upon the colorant, if any, added.

While we have referred above to the use of red oxide, in order to get a simulated brick colour, due to the red colorant, other colorants can be used as required, to obtain colour. Thus, for example, suitable colorants are available to give a green appearance to the layer or a concrete or stone colour appearance. Where these colorants have been built into the layer, it is clear that the colour will remain, even as the surface is worn away over a long period of use.

Where strong visual markings are required in the simulated paving, it is a ready matter to use conventional marking techniques, for example the hot impressing of a colour arrow or other marking. A further advantage of the present material is that thermoplastic paint will adhere thereto; it will not adhere to a genuine brick paved surface.

Where the simulated paved surface is provided over a traffic calming hump, the material forming the upper layer of the humps is found to be particularly effective in that although it can be laid to a substantial depth, a very satisfactory hard-wearing surface can be obtained when it is laid to a depth of approximately 30 mm. The degree of resilience in the material enables it to retain its continuity even after continual use under the shock applied by vehicles bouncing over the hump.

A particularly good hump construction has been found to comprise the base hump being constructed of the hard screed material referred to above and then having the layer material used to provide the simulated paved appearance applied over the base hump. When forming such a hump, troughs will be provided in the road surface, adjacent the front and rear edges of the initially formed base hump, the applied surface layer then having its edges folded into the recesses provided by the troughs so as to provide good wear resistance at the edges of the applied surface layer.

In general, in the foregoing description and the following claims, we have, for the purposes of simplicity and clarity used the terms bitumen, bitumastic and bituminous. It should, however, be noted that while these are the preferred materials, these terms should be interpreted as covering the use of similar materials such as asphalt, e.g. "TRINIDAD LAKE" asphalt and mastic asphalt, and tar.

We claim:

1. A method of laying a bitumastic simulated paved surface which comprises spreading a layer of hot bitumastic material on a foundation layer, the bitumastic material including a thermoplastic rubber copolymer material, filler and reinforcing fibres, allowing the bitumastic material to cool and set, heating the surface of the bitumastic material to soften it for moulding purposes, and imprinting the softened surface with a pattern of grooves to provide simulated gaps between simulated slabs of paving.

2. A method according to claim 1, wherein sand is brushed into the grooves.

3. A method according to claim 1, wherein the bitumastic material contains red oxide whereby the finished surface can be caused to simulate brick paving.

4. A method according to claim 3, wherein the material comprises approximately 10% by weight bitumen, 0.25% rubber crumb or granules, 10% fine powder filler, 35% sand, 3 to 5% red pigment (iron oxide), 0.25% metal and glass fibres, 40% 1 to 3 mm aggregate, 0.25% wetting agent and 0.75% polymers.

5. A method according to claim 1, wherein the bitumastic material including colouring matter to simulate green, concrete or stone, coloured paving.

6. A method according to claim 1, wherein a surface dressing is applied to the layer.

7. A method according to claim 6, wherein the surface dressing is rolled onto the hot bitumastic material before it is initially allowed to cool, prior to the imprinting step.

8. A method according to claim 6, wherein the dressing surface is adhered to the surface after completion of the imprinting step by use of a layer of epoxy resin applied to the moulded surface.

9. A method according to claim 1, wherein the bitumastic material comprises bitumen, hydrocarbon resin, block copolymer rubber, fillers, glass fibres and metal fibres.

10. A method of providing a speed control hump on a road wherein a hump of bitumastic material is provided on the road and there is laid thereon a bitumastic simulated paved surface using the method of claim 1.

11. A method according to claim 10, wherein the material provided to the surface of the road to form the hump comprises rubber chips bound together with a bituminous binder.

12. A method according to claim 11, wherein the material includes preferably less than 1% by weight of chopped fibres.

13. A method according to claim 10, wherein the bituminous binder of the hump comprises a mixture of bitumen and hydrocarbon resin.

14. A method according to claim 13, wherein the hydrocarbon resin is a resin produced by the controlled polymerisation of an unsaturated $C_5$ petroleum fraction and has a softening point of approximately 95° to 105° C.

15. A method according to claim 11, wherein the hump material includes a proportion of aggregate which has a particle size of up to 30 mm, preferably 5 to 15 mm.

16. A method according to claim 11, wherein the rubber chips comprise 5 to 30% by weight of the material.

17. A method according to claim 11, wherein the hump material comprises 5 to 10% bitumen, 5 to 10% hydrocarbon resin, up to 40% mineral fillers, up to 30% rubber chips and the balance as aggregate.

18. A method according to claim 11, wherein the hump material is flexibilised with thermoplastic rubber copolymer material.

19. A method according to claim 18, wherein the copolymer material comprises substantially 1 to 2% by weight of the hump material.

20. A method according to claim 11, wherein the hump material comprises, by weight, approximately 5 parts bitumen, 5 parts hydrocarbon resin, 1 part thermoplastic block copolymer rubber, 30 parts mineral fillers, 35 to 45 parts aggregate, 5 to 30 parts rubber chips and less than 1 part fibre.

21. A method according to claim 11, wherein the rubber chips have a particle size of up to 20 mm, preferably 5 to 15 mm, single sized.

22. A method according to claim 10, wherein the hump of bitumastic material is applied hot to the road and then allowed to solidify.

23. A method according to claim 10, wherein a small trough is provided in the surface of the road, adjacent the front and rear edges of the applied material, the edge of the top layer being recessed within the said trough.

24. A method according to claim 18, wherein the thermoplastic rubber copolymer material is a member selected from the group consisting of styrene butadiene styrene and styrene isoprene styrene.

25. A layer of bitumastic material having a simulated paved surface, comprising bitumen, hydrocarbon resin, block copolymer rubber, fillers and reinforcing fibre material, a groove pattern having been impressed into the upper surface of the layer in a pattern to simulate the joints in a paved surface.

26. A layer according to claim 25, wherein the material includes a colorant to provide a coloured finish.

27. A layer according to claim 25, wherein the material has a surface dressing thereon.

28. A layer according to claim 17, wherein the dressing has been rolled into the upper surface of the layer while it was still soft.

29. A layer according to claim 27, wherein the dressing has been adhered to the surface by first applying a layer of epoxy resin as adhesive.

30. A layer according to claim 25, wherein the bitumastic material comprises constituents in the following relative proportions: 30 to 70 liters of bitumen, up to 3 kg wetting agent, 30 to 170 kg hydrocarbon resin, 3 to 70 kg block copolymer rubber, 800 to 2000 kg filler, 2.5 to 40 kg inorganic fibres and 1.7 to 33 kg rubber chips.

31. A layer according to claim 30, wherein the inorganic fibres comprise 1 to 1.7 kg glass fibres and 1.3 to 20 kg metal fibres.

32. A layer according to claim 30, wherein the material comprises 17 to 83 kg iron oxide as colorant.

33. A layer according to claim 29, wherein the filler comprises fine powder filler, sand and granite chips.

34. A material according to claim 30, wherein the filler also comprises fine crushed flint grit.

35. A layer according to claim 25, which comprises 55 to 70% hard screed material, up to 5% iron oxide, 10 to 15% crushed flint grit, 15 to 25% sand, up to 5% rubber chips having a particle size of 1 to 15 mm, up to 0.5% glass fibres and up to 1% metal fibres, the hard screed material having the proportions of between 150 and 250 liters 100 pen bitumen, up to 4 kg wetting agent, 150 to 300 kg hydrocarbon resin, 20 to 70 kg block copolymer rubber, 1800 to 2400 kg fillers, and up to 10 kg of fibreglass.

36. A layer according to claim 35, wherein the filler of the hard screed comprises approximately 2 parts by weight fine powder filler, 7 parts by weight sand, 4 parts by weight fine crushed flint grit, and 8 parts by weight of 3 mm granite.

37. A layer according to claim 35, which comprises approximately 3% by weight iron oxide, 12% crushed flint grit, 2.0% sand, 0.4% rubber chips, 0.4% metal fibres and 0.2% glass fibres, excluding those included in the screed material.

38. A layer according to claim 25, wherein the layer comprises approximately 10% by weight bitumen, 0.25% rubber crumb or granules, 10% fine powder filler, 35% sand, 3 to 5% red pigment (iron oxide), 0.25% metal and glass fibres, 40% 1 to 3 mm aggregate, 0.25% wetting agent and 0.75% polymers.

39. A road speed control hump, which comprises a hump of material applied to road, the material comprising a mixture having rubber chips bound together with a bituminous binder, and a layer applied to the surface of the hump which is as claimed in claim 24.

40. A speed control hump in accordance with claim 39, wherein the hump material comprises chopped fibres.

41. A speed control hump according to claim 40, wherein the chopped fibres comprise glass and/or metal fibres and comprise less than 1% by weight of the mixture.

42. A speed control hump according to claim 39, wherein the bituminous binder comprises a mixture of bitumen and hydrocarbon resin.

43. A hump according to any one of claim 39, wherein the mixture includes aggregate having a particle size of up to 5 mm, preferably 5 to 15 mm.

44. A hump according to claim 39, wherein the rubber chips have a particle size of up to 20 mm, preferably 5 to 15 mm.

45. A hump according to claim 39, wherein the hump material comprises 5 to 10% bitumen, 5 to 10% hydrocarbon resin, up to 40% mineral fillers, up to 30% rubber chips and the balance aggregates.

46. A hump according to claim 39, wherein the mixture is flexibilised with thermoplastic rubber copolymer material.

47. A hump according to claim 39, wherein the mixture comprises, by weight, approximately 5 parts bitumen, 5 parts hydrocarbon resin, 1 part thermoplastic block copolymer rubber, 30 parts mineral fillers, 35 to 45 parts aggregate, 5 to 30 parts rubber chips and less than 1 part fibre.

48. A hump according to claim 39, wherein the edges of the top layer are received within a small trough, provided in the surface of the road, adjacent the front and rear edges of the hump.

49. A speed control hump according to claim 39, wherein the material is applied to the road to a thickness of at least 50 mm.

50. A speed control hump according to claim 42, wherein the hydrocarbon resin is produced by preferably being a resin produced by the controlled polymerization of an unsaturated $C_5$ petroleum fraction and has a softening point of approximately 95° to 105° C.

51. A hump according to claim 46, wherein the thermoplastic rubber copolymer material comprises a member selected from the group consisting of styrene butadiene styrene or styrene isoprene styrene, the copolymer material comprising approximately 1 to 2% by weight of the hump material.

52. A method of laying a bitumastic simulated paved surface which comprises spreading a layer of hot bitumastic material on a foundation layer, the bitumastic material including a thermoplastic rubber copolymer material, filler and reinforcing fibres, and imprinting the softened surface before the bitumastic material has cooled and set with a pattern of grooves to provide simulated gaps between simulated slabs of paving.

* * * * *

UNITED STATES PATENT AND TRADEMARK OFFICE

CERTIFICATE OF CORRECTION

PATENT NO. : 5,560,734
DATED : October 1, 1996
INVENTOR(S) : James MCINTOSH et al.

It is certified that error appears in the above-identified patent and that said Letters Patent is hereby corrected as shown below:

On the title page, item [73] Assignee should read;

to --Prismo Limited, West Sussex, United Kingdom--.

Signed and Sealed this

Seventh Day of April, 1998

Bruce Lehman

*Attest:*

BRUCE LEHMAN

*Attesting Officer*

*Commissioner of Patents and Trademarks*